US010210789B2

(12) United States Patent
Li et al.

(10) Patent No.: US 10,210,789 B2
(45) Date of Patent: Feb. 19, 2019

(54) DISPLAY PANEL AND DRIVING METHOD THEREOF AND DISPLAY APPARATUS

(71) Applicants: BOE TECHNOLOGY GROUP CO., LTD., Beijing (CN); ORDOS YUANSHENG OPTOELECTRONICS CO., LTD., Ordos, Inner Mongolia (CN)

(72) Inventors: Fuqiang Li, Beijing (CN); Jun Fan, Beijing (CN); Xiaochuan Chen, Beijing (CN); Xue Dong, Beijing (CN)

(73) Assignees: BOE TECHNOLOGY GROUP CO., LTD., Beijing (CN); ORDOS YUANSHENG OPTOELECTRONICS CO., LTD., Ordos, Inner Mongolia (CN)

( * ) Notice: Subject to any disclaimer, the term of this patent is extended or adjusted under 35 U.S.C. 154(b) by 310 days.

(21) Appl. No.: 15/129,650

(22) PCT Filed: Dec. 31, 2015

(86) PCT No.: PCT/CN2015/100137
§ 371 (c)(1),
(2) Date: Sep. 27, 2016

(87) PCT Pub. No.: WO2017/020526
PCT Pub. Date: Feb. 9, 2017

(65) Prior Publication Data

US 2017/0178557 A1 Jun. 22, 2017

(30) Foreign Application Priority Data

Aug. 6, 2015 (CN) ..... 2015 1 0477633

(51) Int. Cl.
*G09G 3/20* (2006.01)
*G09G 3/3266* (2016.01)
*G09G 3/36* (2006.01)

(52) U.S. Cl.
CPC ..... *G09G 3/2092* (2013.01); *G09G 3/3266* (2013.01); *G09G 3/3677* (2013.01);
(Continued)

(58) Field of Classification Search
CPC .. G09G 3/2092; G09G 3/3266; G09G 3/3677; G09G 2310/0218;
(Continued)

(56) References Cited

U.S. PATENT DOCUMENTS 8,564,627 B2 * 10/2013 Suzuki ..... G09G 3/003 345/690
9,583,066 B2 * 2/2017 Jiang ..... G09G 3/3681
(Continued)

FOREIGN PATENT DOCUMENTS

CN 1758303 A 4/2006
CN 101359143 A 2/2009
(Continued)

OTHER PUBLICATIONS

International Search Report and Written Opinion dated Apr. 28, 2016; PCT/CN2015/100137.
(Continued)

*Primary Examiner* — Abhishek Sarma
(74) *Attorney, Agent, or Firm* — Ladas & Parry LLP

(57) ABSTRACT

A display panel, driving method thereof and display apparatus are provided. The display panel comprises 4N gate lines, drive controlling circuit (1) connected to respective gate driving circuits and configured to output a group of timing control signals to respective gate driving circuits, and mode switching circuit (2) connected to drive controlling
(Continued)

circuit (1), which can control drive controlling circuit (1) to drive all gate driving circuits to output scan signals sequentially to respective first gate line groups by taking two adjacent gate lines as first gate line group in scanning direction when receiving first mode control signal; and/or control drive controlling circuit (1) to drive all gate driving circuits to output scan signals sequentially to respective second gate line groups by taking four adjacent gate lines as second gate line group in scanning direction when receiving second mode control signal. Therefore, power consumption can be reduced, and standby-time can be prolonged.

18 Claims, 10 Drawing Sheets

(52) U.S. Cl.
CPC ..... *G09G 2310/0205* (2013.01); *G09G 2310/0218* (2013.01); *G09G 2310/0286* (2013.01); *G09G 2310/08* (2013.01)

(58) Field of Classification Search
CPC ... G09G 2310/0205; G09G 2310/0286; G09G 2310/08
See application file for complete search history.

(56) References Cited

U.S. PATENT DOCUMENTS

| | | | |
|---|---|---|---|
| 2006/0077168 | A1 | 4/2006 | Fujita |
| 2011/0169871 | A1 | 7/2011 | Suzuki et al. |
| 2014/0085347 | A1 | 3/2014 | Yatabe |
| 2016/0019853 | A1 | 1/2016 | Jiang et al. |

FOREIGN PATENT DOCUMENTS

| | | | |
|---|---|---|---|
| CN | 102034448 | A | 4/2011 |
| CN | 104157249 | A | 11/2014 |
| CN | 104966506 | A | 10/2015 |
| CN | 104978943 | A | 10/2015 |
| CN | 104978944 | A | 10/2015 |

OTHER PUBLICATIONS

Second Chinese Office Action dated Mar. 31, 2017; Appln. No. 201510477633.6.

First Chinese Office Action dated Nov. 3, 2016; Appln. No. 201510477633.6.

* cited by examiner

DISPLAY PANEL AND DRIVING METHOD THEREOF AND DISPLAY APPARATUS

TECHNICAL FIELD

The present disclosure relates to a display panel, a driving method thereof and a display apparatus.

BACKGROUND

Nowadays, development of science and technology is changing fast, and a liquid crystal display has been applied widely in electronic display products, such as television set, computer, mobile phone and personal digital assistant apparatus, etc. The liquid crystal display comprises a data driving device, Source Driver, a gate driving device, Gate Driver, and a liquid crystal display panel and so on. Herein, the liquid crystal display panel has a pixel array, while the gate driving device is configured to turn on the corresponding pixel row in the pixel array sequentially, so as to transmit pixel data outputted by a data driver to pixels, thereby displaying images to be displayed.

At present, the gate driving device is generally formed on the array substrate of the liquid crystal display through an array process, i.e., gate driver on array (GOA) process. Such integrated process not only saves cost, but also realizes an artistic design that two sides of the liquid crystal panel are symmetrical. At the same time, it also saves wiring space of a bonding area and a fan-out area of the gate integrated circuit (IC), so that the design of narrow frame can be realized. Furthermore, such integrated process can also save bonding process in gate scan line direction, so that productivity and yield rate are raised. The gate driving device is usually constituted of multiple stages of shift registers connected in cascades. Each stage of shift register is corresponding to one gate line, and is configured to output scan signals to respective gate lines sequentially in scanning direction.

However, as the resolution of display products is increasingly high, the number of gate lines required to be refreshed on the display panel is increasing, which causes that power consumption also increases as the resolution increases. Therefore, the standby time is greatly reduced. Therefore, how to reduce power consumption of the display products to increase standby time is a technical problem urgently to be solved by those skilled in the art.

SUMMARY

Given that, there are provided in embodiments of the present disclosure a display panel, a driving method thereof and a display apparatus. The display panel can reduce resolution in a certain circumstance, so that the power consumption of the display panel is reduced.

There is provided in the embodiments of the present disclosure a display panel comprising 4N gate lines, a first gate driving circuit connected to a (4n+1)-th gate line and a third gate driving circuit connected to a (4n+3)-th gate line, which are located on one side of the display panel, a second gate driving circuit connected to a (4n+2)-th gate line and a fourth gate driving circuit connected to a (4n+4)-th gate line, which are located on another side of the display panel, and a drive controlling circuit connected to respective gate driving circuits and at least configured to output a group of timing control signals to respective gate driving circuits, the time control signals having one-to-one correspondence relationship with the respective gate driving circuits, where n is an integer greater than or equal to 0 and smaller than N. Respective groups of timing control signals comprise at least a trigger signal and a clock signal, widths of trigger signals in the respective groups of timing control signals are the same, and the respective gate driving circuits are used to output scan signals to corresponding gate lines sequentially under the control of a corresponding group of timing control signals received; and further comprising: a mode switching circuit connected to the drive controlling circuit; wherein the mode switching circuit is used to control the drive controlling circuit to drive all the gate driving circuits to output scan signals sequentially to respective first gate line groups by taking two adjacent gate lines as the first gate line group in scanning direction when receiving a first mode control signal; and/or the mode switching circuit is used to control the drive controlling circuit to drive all the gate driving circuits to output scan signals sequentially to respective second gate line groups by taking adjacent four gate lines as the second gate line group in scanning direction when receiving a second mode control signal.

In a possible implementation, in the display panel provided in the embodiment of the present disclosure, when receiving the first mode control signal, the mode switching circuit can be used to:

control the drive controlling circuit to output a second group of timing control signals to the second gate driving circuit while outputting a first group of timing control signals to the first gate driving circuit, and to output a fourth group of timing control signals to the fourth gate driving circuit while outputting a third group of timing control signals to the third gate driving circuit; wherein timing of respective signals in the first group of timing control signals is the same as timing of corresponding signals in the second group of timing control signals, timing of respective signals in the third group of timing control signal is the same as timing of corresponding signals in the fourth group of timing control signals, and timing of respective signals in the third group of timing control signals delays one trigger signal width compared with timing of corresponding signals in the first group of timing control signals.

In a possible implementation, in the display panel provided in the embodiment of the present disclosure, when receiving a second mode control signal, the mode switching circuit can be used to:

control the drive controlling circuit to output the second group of timing control signals to the second gate driving circuit while outputting the first group of timing control signals to the first gate driving circuit, to output the third group of timing control signals to the third gate driving circuit, and to output the fourth group of timing control signal to the fourth gate driving circuit; wherein timing of respective signals in the first group of timing control signals is the same as timing of corresponding signals in the second group of timing control signals, timing of corresponding signals in the third group of timing control signals, and timing of corresponding signal in the fourth group of timing control signals.

Exemplarily, in the display panel provided in the embodiment of the present disclosure, the mode switching circuit is further used to:

control the drive controlling circuit to drive all the gate driving circuits to output scan signals to the N gate lines sequentially in scanning direction when receiving the third mode control signal.

In a possible implementation, in the display panel provided in the embodiment of the present disclosure, when receiving the third mode control signal, the mode switching circuit can be used to:

control the drive controlling circuit to output the first group of timing control signals to the first gate driving circuit, output the second group of timing control signals to the second gate driving circuit, output the third group of timing control signal to the third gate driving circuit, and output the fourth group of timing control signals to the fourth gate driving circuit sequentially; wherein timing of respective signals in the second group of timing control signals delays one half trigger signal width compared with timing of corresponding signals in the first group of timing control signals; timing of respective signals in the third group of timing control signals delays one half trigger signal width compared with timing of corresponding signals in the second group of timing control signals; and timing of respective signals in the fourth group of timing control signals delays one half trigger signal width compared with timing of corresponding signals in the third timing control signal.

In a specific implementation, the display panel provided in the embodiment of the present disclosure is a liquid crystal display panel or an organic light-emitting display panel.

Correspondingly, there is further provided in an embodiment of the present disclosure a driving method of the display panel provided in the embodiment of the present disclosure, comprising:

controlling the drive controlling circuit to drive all gate driving circuits to output scan signals sequentially to respective first gate line groups by taking two adjacent gate lines as the first gate line group in scanning direction when the mode switching circuit receives a first mode control signal;

controlling the drive controlling circuit to drive all the gate driving circuits to output scan signals sequentially to respective second gate line groups by taking adjacent four gate lines as the second gate line group in scanning direction when the mode switching circuit receives a second mode control signal; and controlling the drive controlling circuit to drive all gate driving circuits to output scan signals sequentially to the N gate lines in scanning direction when the mode switching circuit receives a third mode control signal.

Exemplarily, in the driving method provided in the embodiment of the present disclosure, controlling, by the mode switching circuit, the drive controlling circuit to drive all gate driving circuits to output scan signals sequentially to respective first gate line groups by taking two adjacent gate lines as the first gate line group in scanning direction can be:

controlling, by the mode switching circuit, the drive controlling circuit to output a second group of timing control signals to the second gate driving circuit while outputting a first group of timing control signals to the first gate driving circuit, and to output a fourth group of timing control signals to the fourth gate driving circuit while outputting a third group of timing control signals to the third gate driving circuit; wherein timing of respective signals in the first group of timing control signals is the same as timing of corresponding signals in the second group of timing control signals, timing of respective signals in the third group of timing control signals is the same as timing of corresponding signals in the fourth group of timing control signals, and timing of respective signals in the third group of timing control signals delays one trigger signal width compared with timing of corresponding signals in the first group of timing control signals.

Exemplarily, in the driving method provided in the embodiment of the present disclosure, controlling, by the mode switching circuit, the drive controlling circuit to drive all the gate driving circuits to output scan signals sequentially to respective second gate line groups by taking adjacent four gate lines as the second gate line group in scanning direction can be:

controlling the drive controlling circuit to output the second group of timing control signals to the second gate driving circuit while outputting the first group of timing control signals to the first gate driving circuit, to output the third group of timing control signals to the third gate driving circuit, and to output the fourth group of timing control signals to the fourth gate driving circuit; wherein timing of respective signals in the first group of timing control signals is the same as timing of corresponding signals in the second group of timing control signals, timing of corresponding signals in the third group of timing control signals, and timing of corresponding signals in the fourth group of timing control signals.

Exemplarily, in the driving method provided in the embodiment of the present disclosure, controlling, by the mode switching circuit, the drive controlling circuit to drive all gate driving circuits to output scan signals sequentially to the N gate lines in scanning direction can be:

controlling the drive controlling circuit to output the second group of timing control signals to the second gate driving circuit while outputting the first group of timing control signals to the first gate driving circuit, to output the fourth group of timing control signals to the fourth gate driving circuit while outputting the third group of timing control signals to the third gate driving circuit; wherein timing of respective signals in the second group of timing control signals delays one half trigger signal width compared with timing of corresponding signals in the first group of timing control signals; timing of respective signals in the third group of timing control signals delays one half trigger signal width compared with timing of corresponding signals in the second group of timing control signals; and timing of respective signals in the fourth group of timing control signals delays one half trigger signal width compared with timing of corresponding signals in the third group of timing control signal.

Correspondingly, there is further provided in an embodiment of the present disclosure a display apparatus, comprising the display panel provided in the embodiment of the present disclosure.

The driving method of the display panel, the display panel, and the display apparatus provided in the embodiments of the present disclosure further comprise the mode switching circuit connected to the drive controlling circuit, as compared with the existing display panel. The mode switching circuit is used to control the drive controlling circuit to drive all the gate driving circuits to output scan signals sequentially to respective first gate line groups by taking two adjacent gate lines as the first gate line group in scanning direction when receiving a first mode control signal; and/or the mode switching circuit is used to control the drive controlling circuit to drive all the gate driving circuits to output scan signals sequentially to respective second gate line groups by taking adjacent four gate lines as the second gate line group in scanning direction when receiving a second mode control signal. Therefore, in actual applications, a mode control signal can be transmitted to the mode switching circuit of the display panel as required to control the resolution of the display panel to reduce to ½ resolution or reduce to ¼ resolution, so that the display panel would reduce the power consumption and prolong the standby time.

DETAILED DESCRIPTION

Figure 1A:
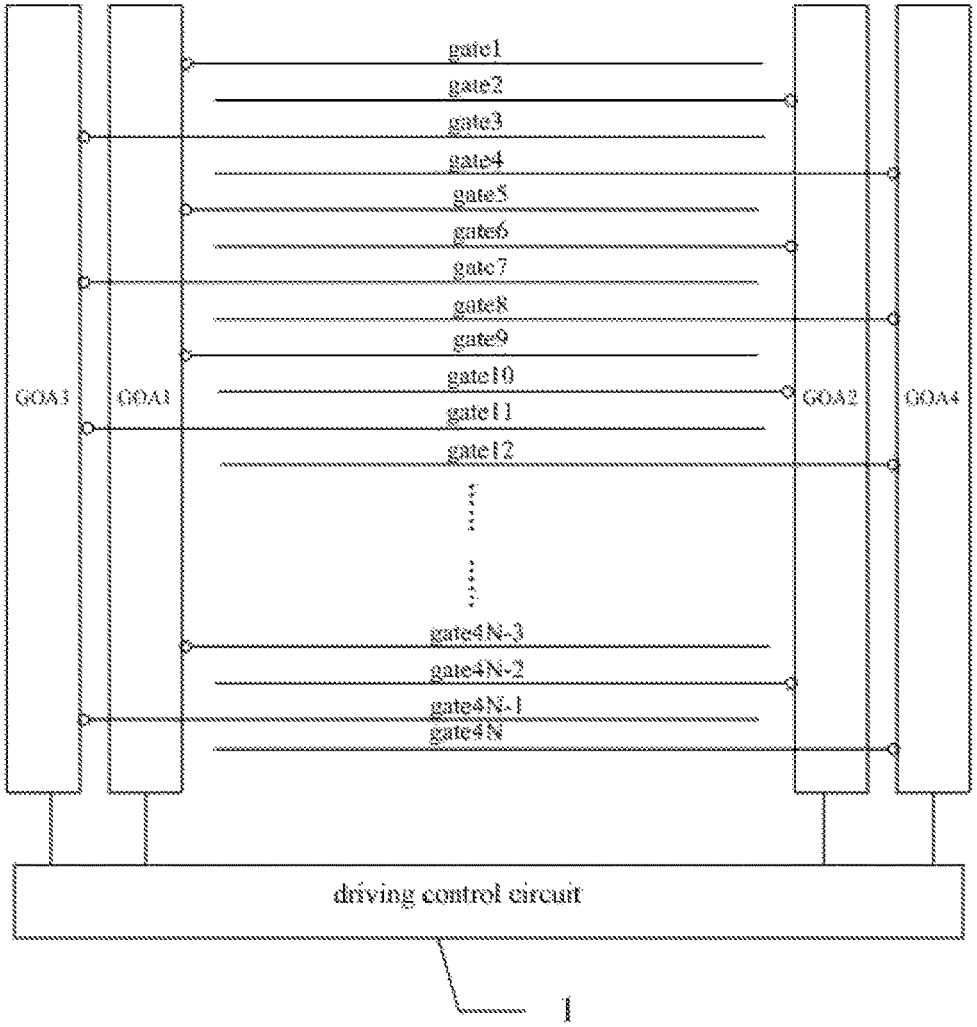
FIG. 1*a* is a schematic diagram of a structure of a known display panel.

FIG. 1*a* shows a schematic diagram of a structure of a known display panel. As shown in FIG. 1*a*, the display panel comprises 4N gate lines, a first gate driving circuit GOA1 connected to a (4n+1)-th gate line (gate 1, gate5, gate9 . . . ) and a third gate driving circuit GOA3 connected to a (4n+3)-th gate line (gate 3, gate 7, gate 11 . . . ), which are located on one side of the display panel, and a second gate driving circuit GOA2 connected to a (4n+2)-th gate line (gate2, gate 6, gate10 . . . ) and a fourth gate driving circuit GOA4 connected to a (4n+4)-th gate line (gate4, gate8, gate12 . . . ), which are located on another side of the display panel, and a drive controlling circuit 1 connected to respective gate driving circuits (GOA1, GOA2, GOA3 and GOA4) and configured to at least output a group of timing control signals to the respective gate driving circuits, the group of timing control signals having one-to-one correspondence relationship with the respective gate driving circuits, where n is an integer greater than or equal to 0 and smaller than N. Respective groups of timing control signals comprise at least trigger signals and clock signals, the width of trigger signals in the respective groups of timing control signals is the same. The respective gate driving circuits are used to output scan signals to corresponding gate lines sequentially under the control of a received corresponding group of timing control signals.

Figure 1B:
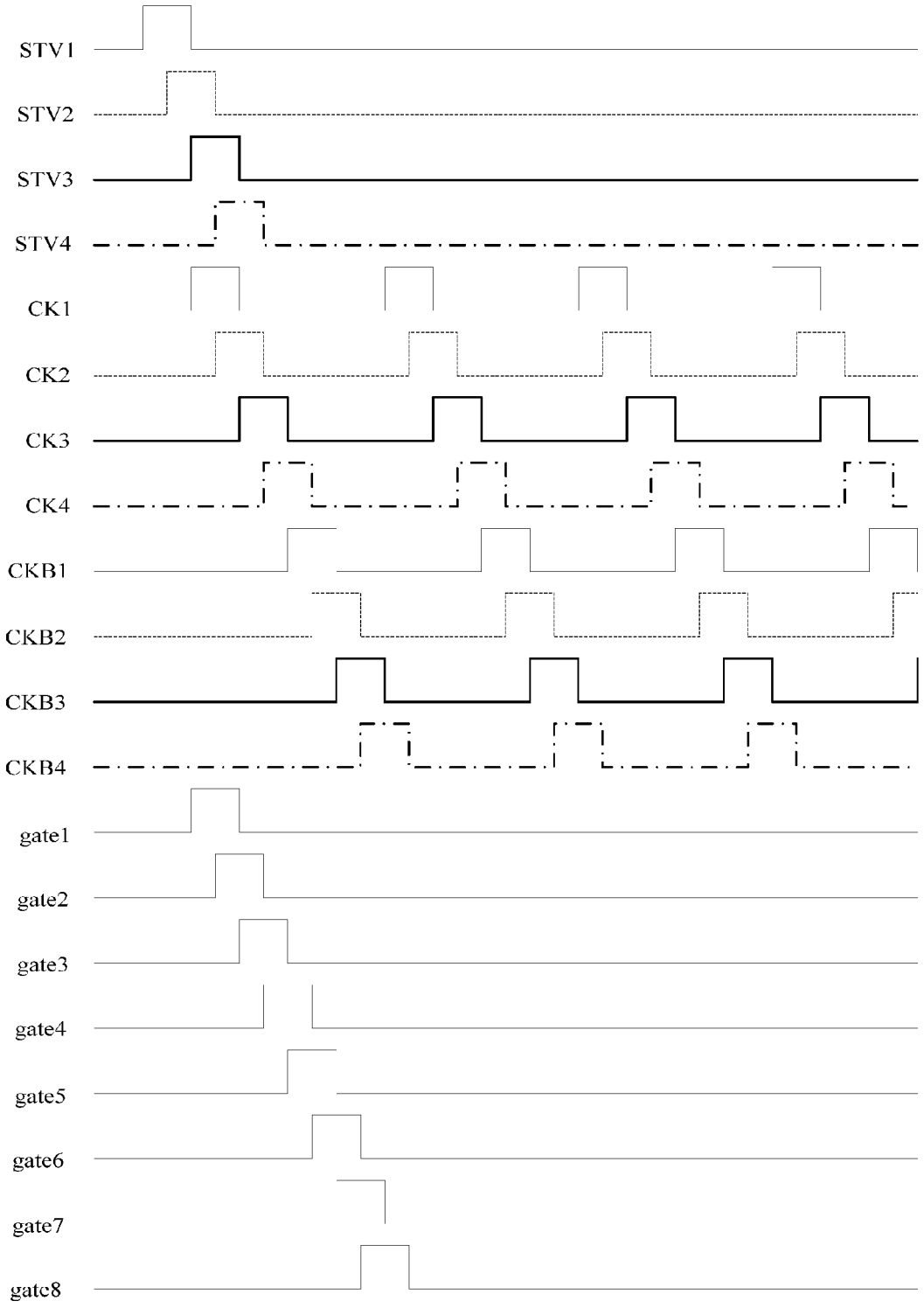
FIG. 1*b* is an input/output timing diagram corresponding to the display panel as shown in FIG. 1*a;*

The first group of timing control signals outputted by the drive controlling circuit 1 to the first gate driving circuit GOA1 comprises: a first trigger signal STV1, a first clock signal CK1 and a second clock signal CKB1; the second group of timing control signals outputted to the second gate driving circuit GOA2 comprises: a second trigger signal STV2, a third clock signal CK2, and a fourth clock signal CKB2; the third group of timing control signals outputted to the third gate driving circuit GOA3 comprises: a third trigger signal STV3, a fifth clock signal CK3 and a sixth clock signal CKB3; the fourth group of timing control signals outputted to the fourth gate driving circuit GOA4 comprises: a fourth trigger signal STV4, a seventh clock signal CK4 and an eighth clock signal CKB4. In order to realize driving all the gate driving circuits to output successively the scan signals to the N gate lines in a scanning direction, the drive controlling circuit 1 makes timings of respective signals in the second group of timing control signals delay one half trigger signal width compared with the timings of corresponding signals in the first group of timing control signals; the timings of respective signals in the third group of timing control signals delay one half trigger signal width compared with the timings of corresponding signals in the second group of timing control signals, and the timings of respective signals in the fourth group of timing control signals delay one half of trigger signal width compared with the timings of corresponding signals in the third group of timing control signals; furthermore, and two clock signals in the respective groups of timing control signals have a difference of one trigger signal width in timing. In particular, the timings of the respective groups of timing control signals and the scan signals on the gate lines (gate1, gate2, gate3 . . . ) are as shown in FIG. 1*b*, wherein FIG. 1*b* shows only the timings of scan signals on the previous 8 gate lines, and scan signals on the remaining gate lines may be deduced by analogy.

In the above display panel, the respective gate driving circuit can realize only the function of scanning gate lines progressively under the control of the drive controlling circuit 1. In this way, when resolution of the display panel is relatively high, power consumption would increase as the resolution increases, thereby resulting in great reduction of standby time. In actual application, in some circumstances, for example, in a circumstance of being inconvenient to charge, we need the display apparatus continues to display, and also wish a display having a relatively long standby time. Therefore, it is necessary to provide a display panel that is capable of reducing power consumption as required.

The present disclosure provides a display panel that can reduce the power consumption according to the requirement based on the display panel having the above connection mode.

Specific implementations of the display panel, a driving method thereof and a display apparatus provided in embodiments of the present disclosure will be described in detail below in connection with the accompanying figures.

Figure 2:
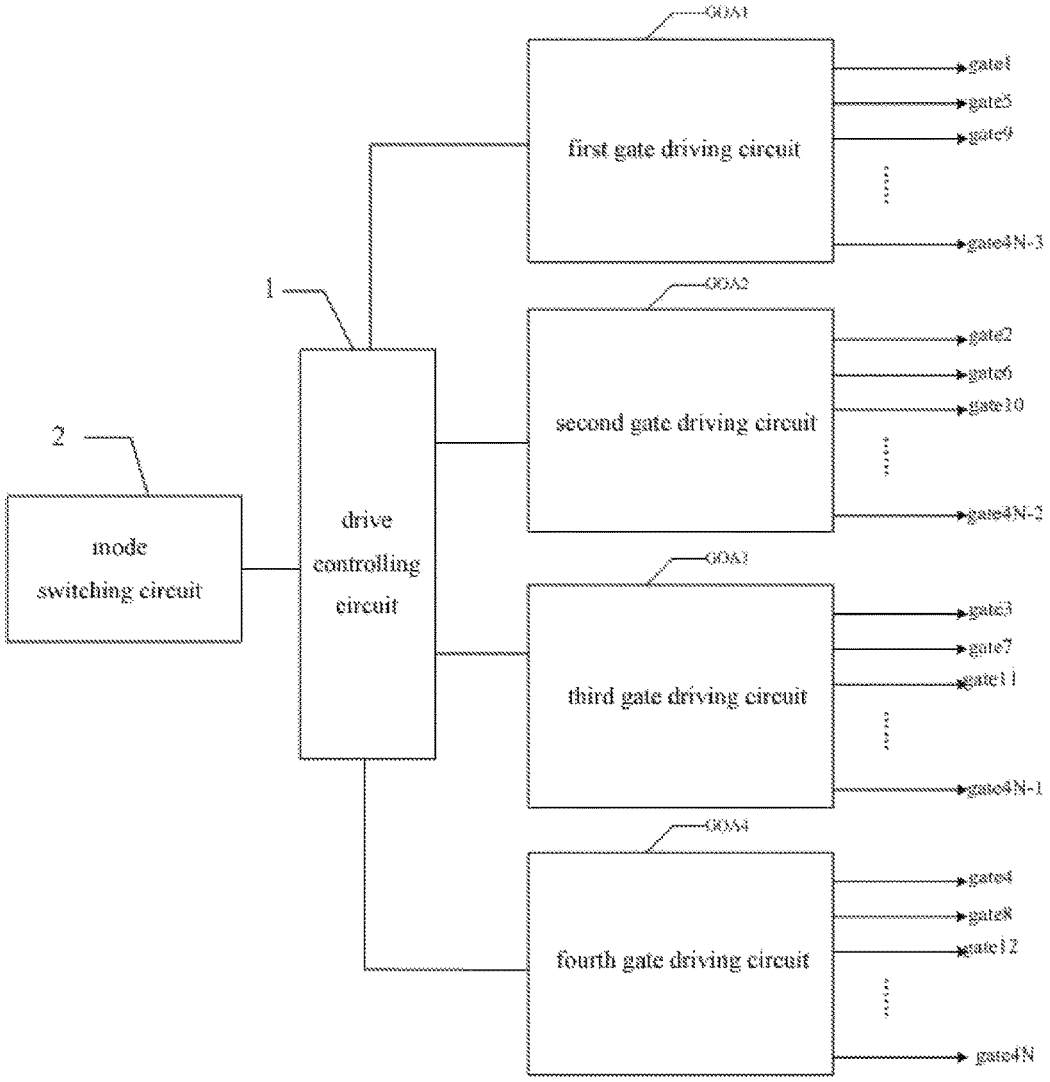
FIG. 2 is a schematic diagram of a structure of a display structure provided in an embodiment of the present disclosure.

FIG. 2 shows a schematic diagram of a structure of a display panel provided in an embodiment of the present disclosure. As shown in FIGS. 1*a* and 2, the display panel comprises 4N gate lines, a first gate driving circuit GOA1 connected to a (4n+1)-th gate line (gate 1, gate5, gate9 . . . ) and a third gate driving circuit GOA3 connected to a (4n+3)-th gate line (gate 3, gate 7, gate 11 . . . ), which are located on one side of the display panel, and a second gate driving circuit GOA2 connected to a (4n+2)-th gate line (gate2, gate 6, gate10 . . . ) and a fourth gate driving circuit GOA4 connected to a (4n+4)-th gate line (gate4, gate8, gate12 . . . ), which are located on another side of the display panel, and a drive controlling circuit 1 connected to respective gate driving circuits (GOA1, GOA2, GOA3 and GOA4) and configured to at least output a group of timing control signals to the respective gate driving circuits (GOA1, GOA2, GOA3 and GOA4), the group of timing control signals having one-to-one correspondence relationship with the respective gate driving signals, where n is an integer greater than or equal to 0 and smaller than N. Respective groups of timing control signals comprise at least trigger signals and clock signals, the width of trigger signals in the respective groups of timing control signals is the same, and the respective gate driving circuits (GOA1, GOA2, GOA3 and GOA4) are used to output scan signals to corresponding gate lines sequentially under the control of a received corresponding group of timing control signals. As shown in FIG. 2, the display panel further comprises: a mode switching circuit 2 connected to the drive controlling circuit 1.

In the display panel as shown in FIG. 2, the mode switching circuit 2 can be used to control the drive controlling circuit 1 to drive all the gate driving circuits (GOA1, GOA2, GOA3, and GOA4) to output scan signals sequentially to respective first gate line groups by taking two adjacent gate lines as the first gate line group in the scanning direction when receiving a first mode control signal. That is, the display panel scans synchronously with two gate lines, and resolution of the display panel reduces to ½ resolution.

Alternatively, the mode switching circuit 2 can be further used to control the drive controlling circuit 1 to drive all the gate driving circuits (GOA1, GOA2, GOA3, and GOA4) to output scan signals sequentially to respective second gate line groups by taking adjacent four gate lines as the second gate line group in the scanning direction when receiving a second mode control signal. That is, the display panel scans synchronously with four gate lines, and resolution of the display panel reduces to ¼ resolution.

It could be noted that compared with the display panel as shown in FIG. 1, the display panel provided in the embodiment of the present disclosure as shown in FIG. 2 further comprises a mode switching circuit 2 connected to the drive controlling circuit 1. The mode switching circuit 2 is configured to control the drive controlling circuit 1 to drive all the gate driving circuits to output scan signals sequentially to respective first gate line groups by taking two adjacent gate lines as the first gate line group in the scanning direction when receiving the first mode control signal; and/or the mode switching circuit 2 can be further used to control the drive controlling circuit 1 to drive all the gate driving circuits to output scan signals sequentially to respective second gate line groups by taking adjacent four gate lines as the second gate line group in the scanning direction when receiving the second mode control signal. Therefore, in actual applications, the mode control signals can be transmitted to the mode switching circuit 2 of the display panel as required to control the resolution of the display panel to reduce to ½ resolution or reduce to ¼ resolution, so as to reduce power consumption of the display panel and prolong standby time of the display panel.

Exemplarily, in the display panel provided in the embodiment of the present disclosure, when receiving the first mode control signal, the mode switching circuit 2 can be used to:

control the drive controlling circuit 1 to output a second group of timing control signals to the second gate driving circuit while outputting a first group of timing control signals to the first gate driving circuit, and to output a fourth group of timing control signals to the fourth gate driving circuit while outputting a third group of timing control signals to the third gate driving circuit.

Figure 3A:
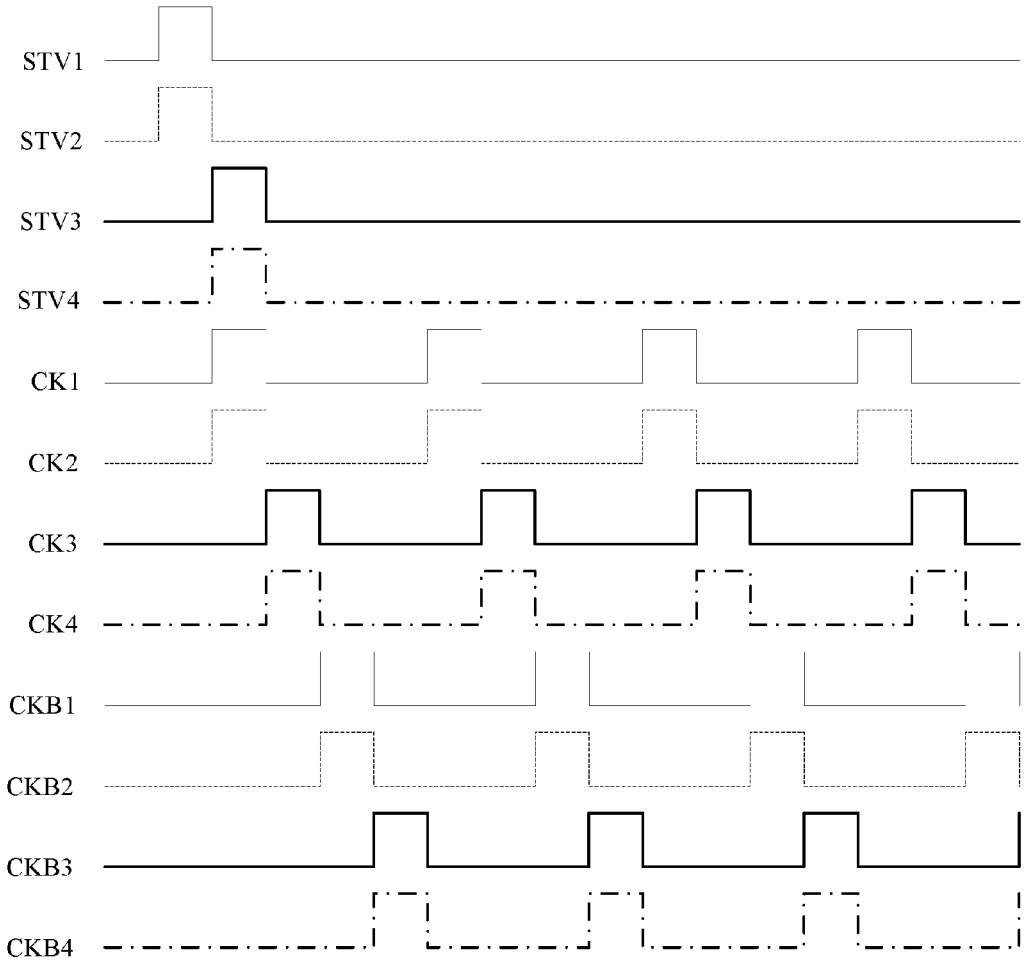
FIG. 3*a* is a timing diagram of four groups of timing control signals outputted by controlling a drive controlling circuit when a mode switching circuit receives a first mode control signal in a display panel provided in an embodiment of the present disclosure.

FIG. 3*a* shows a timing diagram of four groups of timing control signals outputted by controlling a drive controlling circuit when the mode switching circuit 2 receives a first mode control signal in a display panel provided in an embodiment of the present disclosure.

As shown in FIG. 3*a*, timings of respective signals in the first group of timing control signals (including at least a first trigger signal STV1, a first clock signal CK1 and a second clock signal CKB1) are the same as timings of corresponding signals in the second group of timing control signals (including at least a second trigger signal STV2, a third clock signal CK2 and a fourth clock signal CKB2), timings of respective signals in the third group timing control signal (including at least a third trigger signal STV3, a fifth clock signal CK3 and a sixth clock signal CKB3) are the same as timings of corresponding signals in the fourth group of timing control signals (including at least a fourth trigger signal STV4, a seventh clock signal CK4 and an eighth clock signal CKB4), and timings of respective signals in the third group of timing control signals delay one trigger signal width compared with timings of respective signals in the first group of timing control signals. That is, this is equivalent to changing the timings of the second group of timing control signals to be consistent with the timings of the first group of timing control signals, and the timings of the fourth group of timing control signals to be consistent with the timing of the third group of timing control signals on the basis of the times of four groups of timing control signals that are known and realize driving progressively.

Figure 3B:
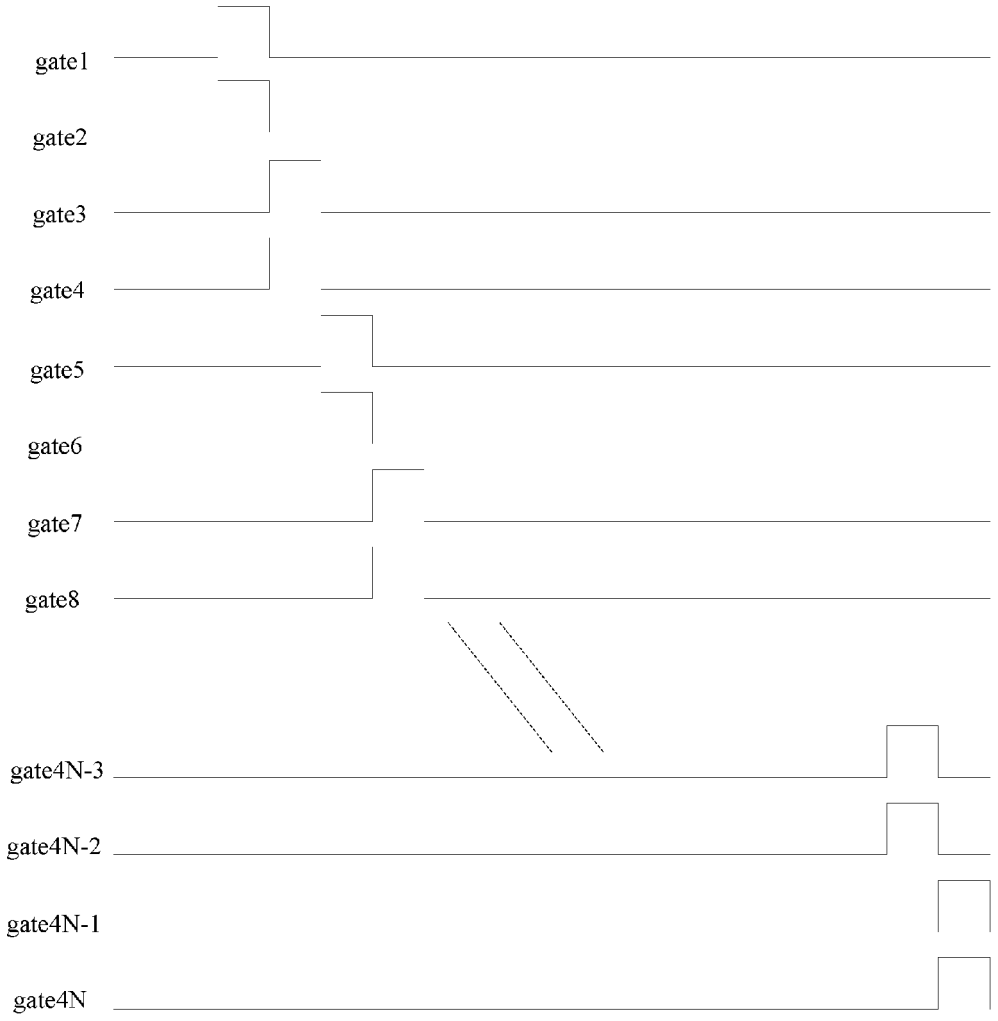
FIG. 3*b* is a timing diagram of scan signals on corresponding gate lines when a timing diagram of respective groups of timing control signals is as shown in FIG. 3*a* in a display panel provided in an embodiment of the present disclosure.

FIG. 3*b* shows a timing diagram of scan signals on corresponding gate lines (gate1, gate2, gate3 . . . ) in a corresponding display panel when a timing diagram of respective groups of timing control signals is as shown in FIG. 3*a* in a display panel provided in an embodiment of the present disclosure.

Exemplarily, in the display panel provided in the embodiment of the present disclosure, when receiving the second mode control signal, the mode switching circuit 2 can be used to:

control the drive controlling circuit 1 to output the second group of timing control signals to the second gate driving circuit to output the third group of timing control signals to the third gate driving circuit, and to output the fourth group of timing control signals to the fourth gate driving circuit, while outputting the first group of timing control signals to the first gate driving circuit.

Figure 4A:
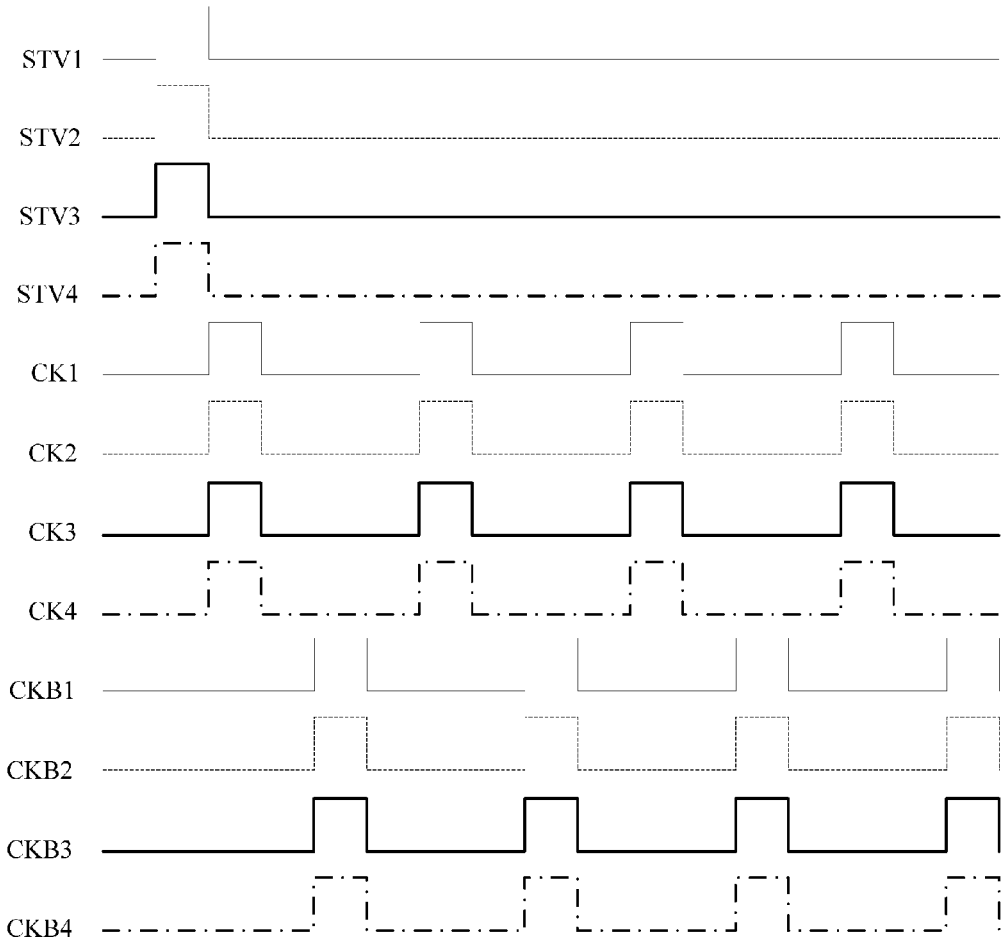
FIG. 4*a* is a timing diagram of four groups of timing control signals outputted by controlling a drive controlling circuit when a mode switching circuit receives a second mode control signal in a display panel provided in an embodiment of the present disclosure.

FIG. 4*a* shows a timing diagram of four groups of timing control signals outputted by controlling the drive controlling circuit 1 when the mode switching circuit 2 receives a second mode control signal in a display panel provided in an embodiment of the present disclosure. As shown in FIG. 4*a*, timings of respective signals in the first group of timing control signals (including at least a first trigger signal STV1, a first clock signal CK1 and a second clock signal CKB1) are the same as timings of corresponding signals in the second group of timing control signals (including at least a second trigger signal STV2, a third clock signal CK2 and a fourth clock signal CKB2), timings of respective signals in the third group timing control signal (including at least a third trigger signal STV3, a fifth clock signal CK3 and a sixth clock signal CKB3), and timings of corresponding signals in the fourth group of timing control signals (including at least a fourth trigger signal STV4, a seventh clock signal CK4 and an eighth clock signal CKB4). That is, this is equivalent to setting the timings of the four group of timing control signals to be consistent on the basis of four groups of timing control signals that are known and realize driving progressively.

Figure 4B:
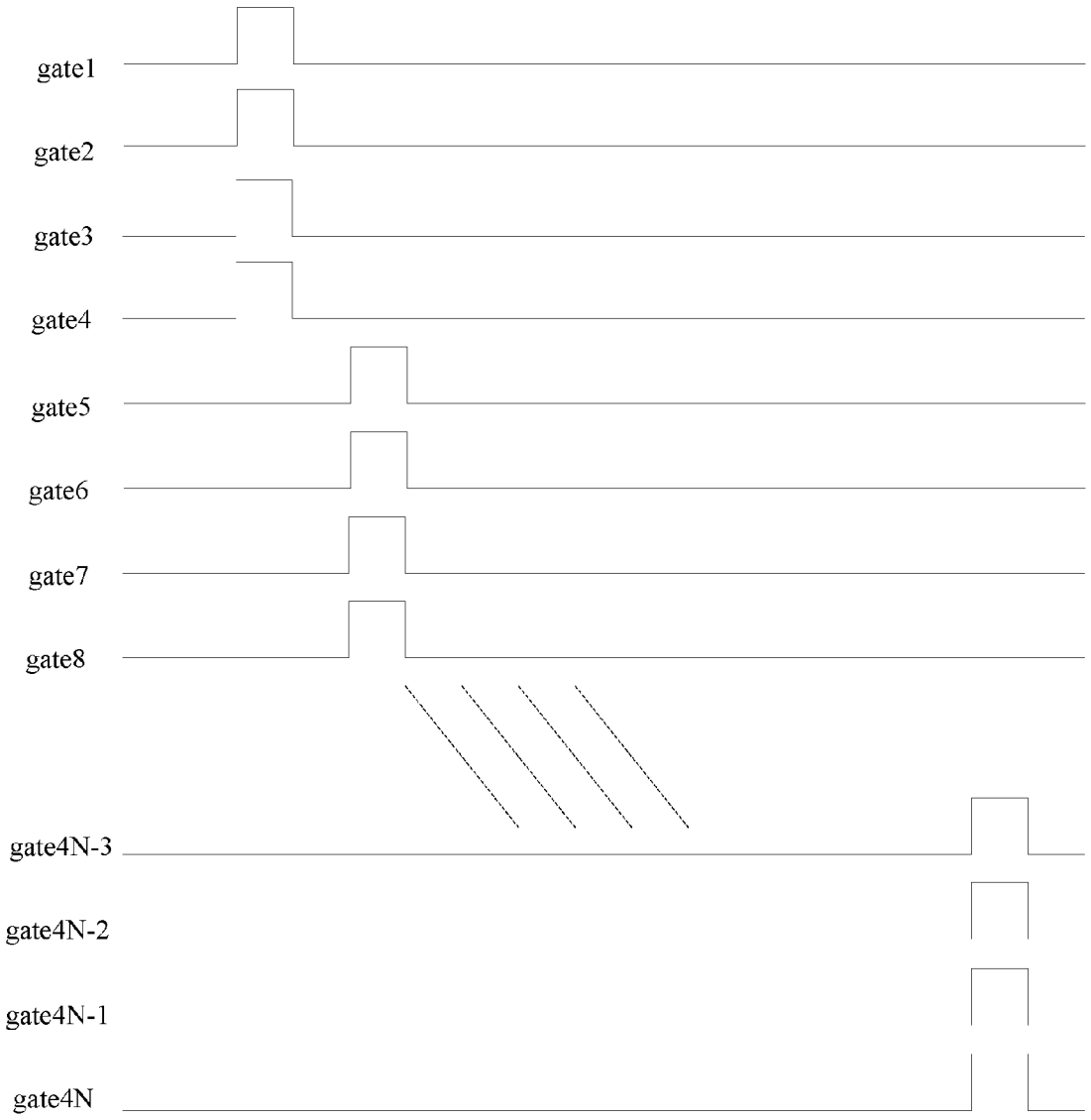
FIG. 4*b* is a timing diagram of scan signals on corresponding gate lines when a timing diagram of respective groups of timing control signals is as shown in FIG. 4*a* in a display panel provided in an embodiment of the present disclosure.

FIG. 4*b* shows a timing diagram of scan signals on gate lines (gate1, gate2, gate3 . . . ) when a timing diagram of respective groups of timing control signals is as shown in FIG. 4*a* in a display panel provided in an embodiment of the present disclosure.

Further, in the display panel provided in the embodiment of the present disclosure, the mode switching circuit 2 can further be used to:

control the drive controlling circuit 1 to drive all the gate driving circuits to output scan signals to the N gate lines sequentially in the scanning direction when receiving the third mode control signal. In this way, the display panel provided in the embodiment of the present disclosure can not only be configured to display with a low resolution when it needs to save electricity, but also realize displaying with a high resolution when it does not need to save electricity.

Exemplarily, in the display panel provided in the embodiments of the present disclosure, when receiving the third mode control signal, the mode switching circuit 2 can be used to:

control the drive controlling circuit 1 to output the first group of timing control signals to the first gate driving circuit, output the second group of timing control signals to the second gate driving circuit, output the third group of timing control signal to the third gate driving circuit, and output the fourth group of timing control signals to the fourth gate driving circuit sequentially.

The timing diagram at this time is consistent with the timing of the four group of timing control signals that are known and realize driving progressively. As shown in FIG. 1*b*, the timings of respective signals in the second group of timing control signals (including at least the second trigger signal STV2, the third clock signal CK2 and the fourth clock signal CKB2) delay one half width of the trigger signal compared with the timings of corresponding signals in the first group of timing control signals (including at least the first trigger signal STV1, the first clock signal CK1 and the second clock signal CKB1); timings of respective signals in the third group of timing control signals (including at least the third trigger signal STV3, the fifth clock signal CK3 and the sixth clock signal CKB3) delay one half width of the trigger signal compared with the timings of corresponding signals in the second group of timing control signals; timings of respective signals in the fourth group of timing control signals (including at least the fourth trigger signal STV4, the seventh clock signal CK4 and the eighth clock signal CKB4) delay one half width of the trigger signal compared with timings of corresponding signals in the third group of timing control signals. The detailed description is the same as the description by referring to FIG. 1*b*, and thus no further description is given herein.

In a specific implementation, in the display panel provided in the embodiments of the present disclosure, the user can transmit the mode control signal to the mode switching circuit 2 through an operation interface of the display panel as required actually, to which no limitation is made.

Controlling of one gate driving circuit by a group of timing control signals will be described by taking a specific embodiment as an example.

Figure 5A:
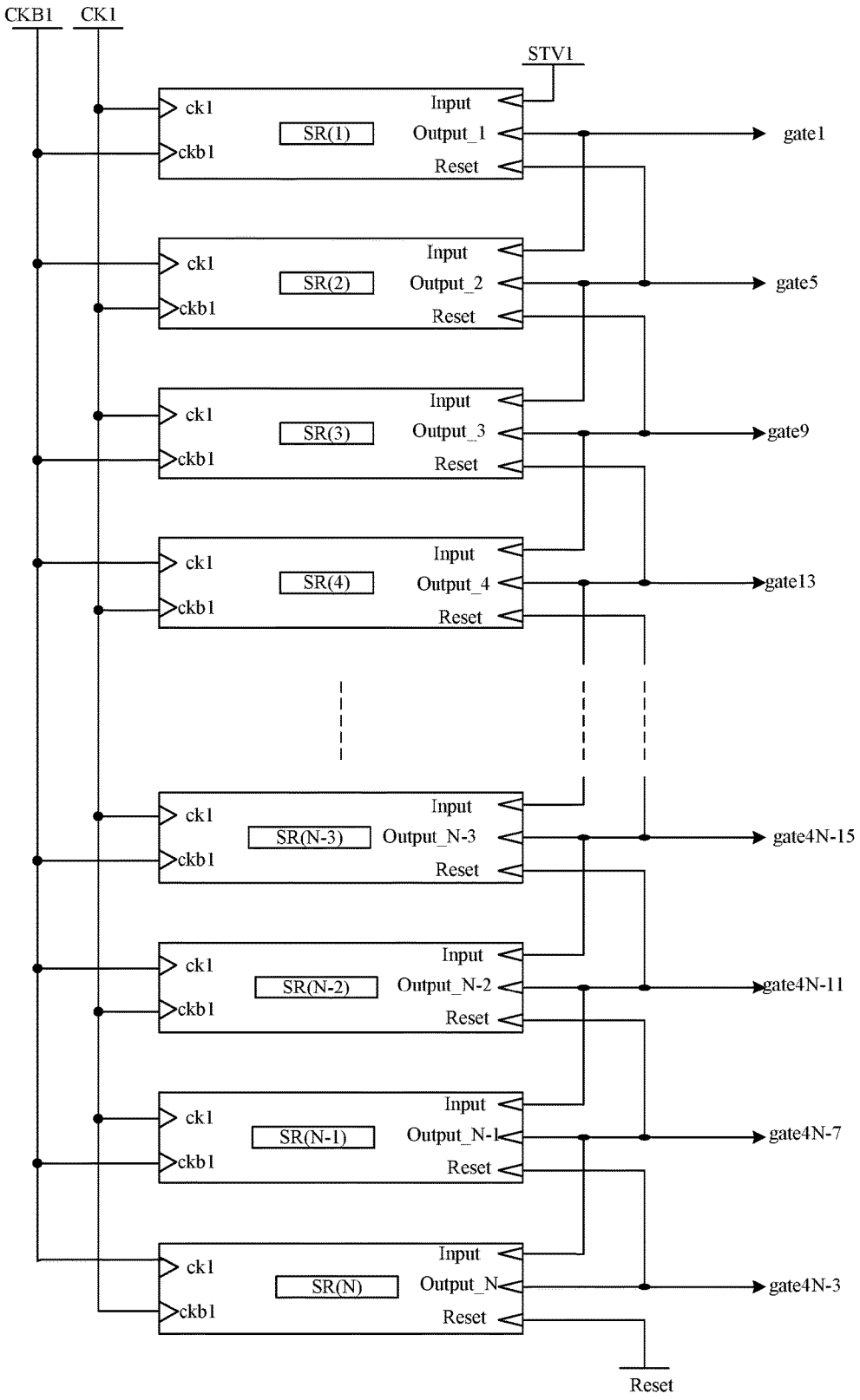
FIG. 5*a* is a schematic diagram of a structure of a gate driving circuit provided in an embodiment of the present disclosure.

FIG. 5*a* shows a schematic diagram of a structure of a gate driving circuit provided in an embodiment of the present disclosure. As shown in FIG. 5*a*, the gate driving circuit is constituted of a plurality of shift registers connected in cascades, i.e., SR(1), SR(2) SR(m) SR(N−1), SR(N) (totally N shift registers, 1≤m≤N. Except a last stage of shift register SR(N), an output terminal Output_m (1≤m≤N) of each of remaining stages of shift registers SR(m) provides an input signal Input to an adjacent next stage of shift register SR(m+1) respectively. An input signal Input of a first stage of shift register SR(1) is a trigger signal received by the gate driving circuit; the gate driving circuit outputs scan signals to corresponding gate lines sequentially through the output terminals Output_m of respective stages of shift registers SR(m). By taking the first stage of gate driving circuit GOA as an example, the drive controlling circuit inputs a first trigger signal STV1 to the first stage of shift register SR(1), and inputs a first clock signal CK1 and a second clock signal CKB1 to respective stages of shift register SR(m). After the first stage of shift register receives the first trigger signal STV1, a scan signal is outputted to a first gate line gate 1 when a first active pulse signal of the first clock signal CK1 starts to be received; the scan signal outputted by the first stage of shift register SR(1) is taken as an input signal Input of a second stage of shift register SR(2), and after the second stage of shift register SR(2) receives the scan signal outputted by the first stage of shift register SR(1), a scan signal is outputted to a fifth gate line gate 5 when the first active pulse signal of the second clock signal CKB1 starts to be received; the scan signal outputted by the second stage of shift register SR(2) is taken as an input signal Input of a third stage of shift register SR(3), and after the third stage of shift register SR(3) receives a scan signal outputted by the second stage of shift register SR(2), a scan signal is outputted to a ninth gate line gate 9 when the first active pulse signal of the first clock signal CK1 starts to be received; a scan signal outputted by the third stage of shift register SR(3) is taken as an input signal Input of a fourth stage shift register SR(4), and after the fourth stage of shift register SR(4) receives the scan signal outputted by the third stage of shift register SR(3), a scan signal is outputted to the thirteenth gate line gate13 when the first active pulse signal of the second clock signal CKB2 starts to be received; by analogy, the respective stages of shift registers output scan signals to corresponding gate lines sequentially.

Figure 5B:
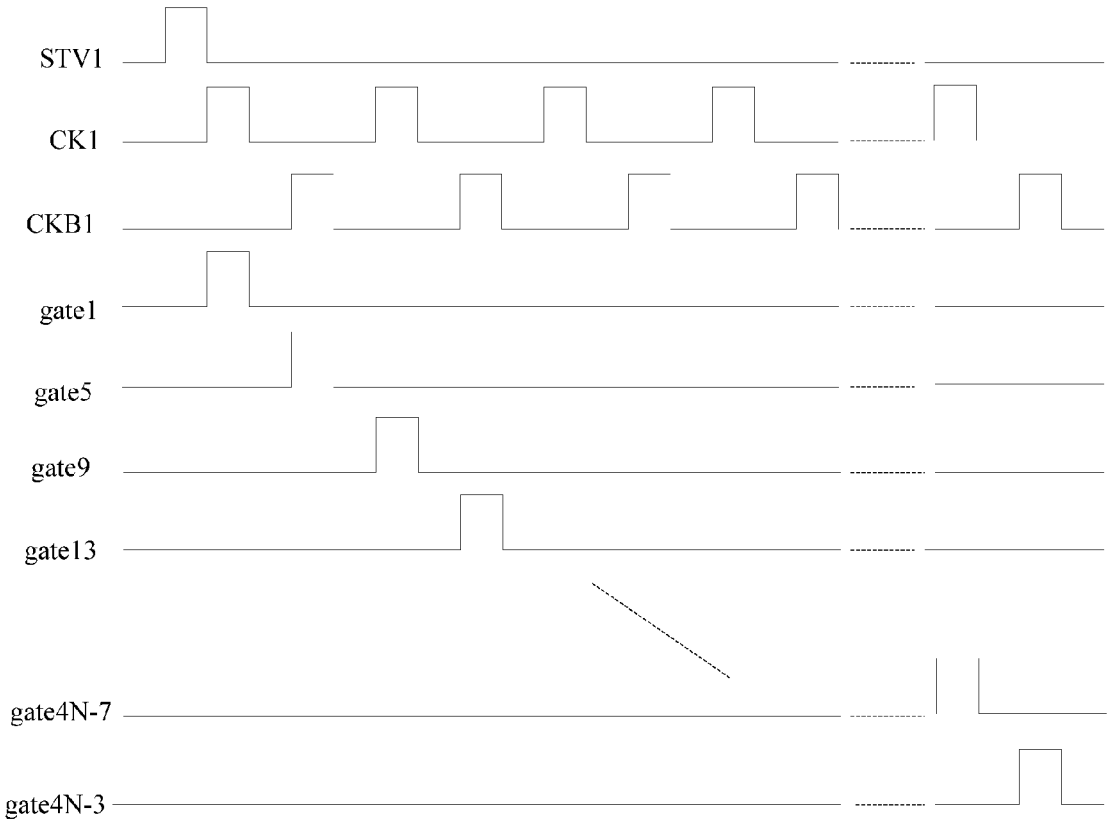
FIG. 5*b* is an input/output timing diagram of a first gate driving circuit provided in an embodiment of the present disclosure.

FIG. 5*b* shows an input/output timing diagram corresponding to the first stage of gate driving circuit. It should be noted that in the display panel provided in the embodiments of the present disclosure, in the first node control signal, the second mode control signal and the third mode control signal, the duration of maintaining the respective mode control signals is an integral multiple of the duration for scanning the 4N gate lines, and a switching point between any two mode control signals is in synchronous with a starting point of scanning the gate line.

The second gate driving circuit, the third gate driving circuit, and the fourth gate driving circuit have the same operation principle as that of the first gate driving circuit. No further description is given herein.

Further, the display panel provided in the embodiment of the present disclosure may be either a liquid crystal display panel or an organic light-emitting display panel, to which no limitation is made.

Based on the same inventive concept, there is further provided in the embodiments of the present disclosure a display, comprising any one of display panel provided in the embodiments of the present disclosure. The display apparatus can be any product or elements having a display function, such as a mobile phone, a tablet computer, a television set, a display, a notebook computer, a digital frame, a navigator and so on. The implementation of the display apparatus can refer to the embodiments of the display panel. No further description is given herein.

Based on the same inventive concept, there is further provided in the embodiments of the present disclosure a driving method of the display panel described above.

Figure 6:
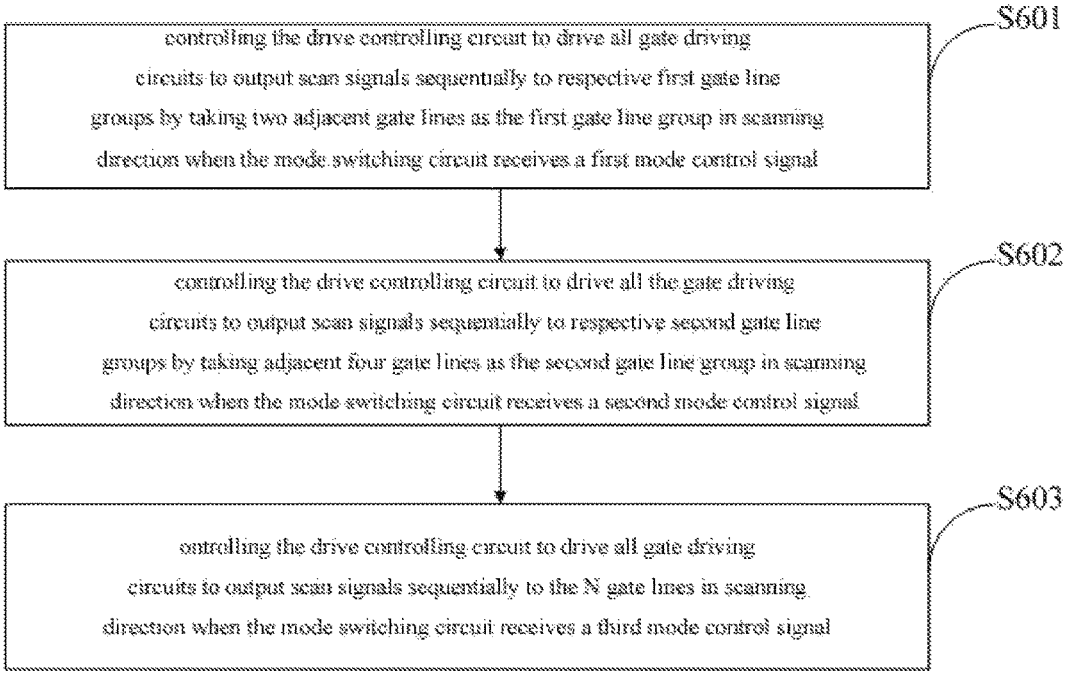
FIG. 6 is a flow diagram of a driving method of a display panel provided in an embodiment of the present disclosure.

FIG. 6 shows a flow diagram of a driving method of a display panel provided in an embodiment of the present disclosure.

As shown in FIG. 6, the driving method of the display panel comprises following operation processes:

In step S601, controlling the drive controlling circuit to drive all gate driving circuits to output scan signals sequentially to respective first gate line groups by taking two adjacent gate lines as the first gate line group in scanning direction when the mode switching circuit receives a first mode control signal;

in step S602, controlling the drive controlling circuit to drive all the gate driving circuits to output scan signals sequentially to respective second gate line groups by taking adjacent four gate lines as the second gate line group in scanning direction when the mode switching circuit receives a second mode control signal; and in step S603, controlling the drive controlling circuit to drive all gate driving circuits to output scan signals sequentially to the N gate lines in scanning direction when the mode switching circuit receives a third mode control signal.

It should be noted that in the driving method provided in the embodiments of the present disclosure, step S601, step S602 and step S603 have a relationship of selecting one therefrom, i.e., determining to perform which one step depending on the mode control signal received by the mode switching circuit.

Exemplarily, in the driving method provided in the embodiment of the present disclosure, controlling, by the mode switching circuit, the drive controlling circuit to drive all the gate driving circuits to output scan signals sequentially to respective first gate line groups by taking adjacent two gate lines as the first gate line group in scanning direction can be implemented in the following mode:

controlling, by the mode switching circuit, the drive controlling circuit to output a second group of timing control signals to the second gate driving circuit while outputting a first group of timing control signals to the first gate driving circuit, and to output a fourth group of timing control signals to the fourth gate driving circuit while outputting a third group of timing control signals to the third gate driving circuit; wherein timing of respective signals in the first group of timing control signals is the same as timing of corresponding signals in the second group of timing control signals, timing of respective signals in the third group of timing control signals is the same as timing of corresponding signals in the fourth group of timing control signals, and timing of respective signals in the third group of timing control signals delays one trigger signal width compared with timing of corresponding signals in the first group of timing control signals.

Exemplarily, in the driving method provided in the embodiment of the present disclosure, controlling, by the mode switching circuit, the drive controlling circuit to drive all the gate driving circuits to output scan signals sequentially to respective second gate line groups by taking adjacent four gate lines as the second gate line group in scanning direction can be implemented in the following mode:

controlling the drive controlling circuit to output the second group of timing control signals to the second gate driving circuit while outputting the first group of timing control signals to the first gate driving circuit, to output the third group of timing control signals to the third gate driving circuit, and to output the fourth group of timing control signals to the fourth gate driving circuit; wherein timings of respective signals in the first group of timing control signals are the same as timings of corresponding signals in the second group of timing control signals, timings of corresponding signals in the third group of timing control signal, and timings of corresponding signal in the fourth group of timing control signals.

Exemplarily, in the driving method provided in the embodiment of the present disclosure, controlling, by the mode switching circuit, the drive controlling circuit to drive all gate driving circuits to output scan signals sequentially to the N gate lines in scanning direction can be implemented in the following mode:

controlling the drive controlling circuit to output the second group of timing control signals to the second gate driving circuit while outputting the first group of timing control signals to the first gate driving circuit, and to output the fourth group of timing control signals to the fourth gate driving circuit while outputting the third group of timing control signals to the third gate driving circuit; wherein timings of respective signals in the second group of timing control signals delay one half width of the trigger signal compared with timings of corresponding signals in the first group of timing control signals; timings of respective signals in the third group of timing control signals delay one half width of the trigger signal compared with timings of corresponding signals in the second group of timing control signals; and timings of respective signals in the fourth group of timing control signals delay one half width of the trigger signal compared with timings of corresponding signals in the third timing control signal.

The display panel, the driving method of the display panel, and the display apparatus provided in the embodiments of the present disclosure further comprise the mode switching circuit connected to the drive controlling circuit as compared with the existing display panel. The mode switching circuit is used to control the drive controlling circuit to drive all the gate driving circuits to output scan signals sequentially to respective first gate line groups by taking two adjacent gate lines as the first gate line group in scanning direction when receiving a first mode control signal; and/or the mode switching circuit is used to control the drive controlling circuit to drive all the gate driving circuits to output scan signals sequentially to respective second gate line groups by taking adjacent four gate lines as the second gate line group in scanning direction when receiving a second mode control signal. Therefore, in actual application, a mode control signal can be transmitted to the mode switching circuit of the display panel according to the requirement to control resolution of the display panel to reduce to ½ resolution or reduce to ¼ resolution, so that the display panel would reduce power consumption and prolong standby time.

Obviously, those skilled in the art can make various alternations and modifications to the present disclosure without departing from the spirit and scope of the present disclosure. As such, if these alternations and modifications of the present disclosure belong to the scope of the claims of the present disclosure as well as its equivalent technique, then the present disclosure also intends to include these alternations and modifications.

The present application claims the priority of a Chinese patent application No. 201510477633.6 filed on Aug. 6, 2015. Herein, the content disclosed by the Chinese patent application is incorporated in full by reference as a part of the present disclosure.

What is claimed is:

1. A display panel, comprising 4N gate lines; a first gate driving circuit connected to a (4n+1)-th gate line and a third gate driving circuit connected to a (4n+3)-th gate line, which are located on one side of the display panel; a second gate driving circuit connected to a (4n+2)-th gate line and a fourth gate driving circuit connected to a (4n+4)-th gate line, which are located on another side of the display panel; and a drive controlling circuit connected to respective gate driving circuits and configured to at least output a group of timing control signals to the respective gate driving circuits, the group of timing control signals having one-to-one correspondence relationship with the respective gate driving circuits, where n is an integer greater than or equal to 0 and smaller than N, and further comprising: a mode switching circuit connected to the drive controlling circuit; wherein the mode switching circuit is configured to control the drive controlling circuit to drive all the gate driving circuits to output scan signals sequentially to respective first gate line groups by taking two adjacent gate lines as the first gate line group in scanning direction when receiving a first mode control signal; and/or the mode switching circuit is configured to control the drive controlling circuit to drive all the gate driving circuits to output scan signals sequentially to respective second gate line groups by taking adjacent four gate lines as the second gate line group in scanning direction when receiving a second mode control signal.

2. The display panel according to claim 1, wherein respective groups of timing control signals comprise at least a trigger signal and a clock signal, and widths of trigger signals in the respective groups of timing control signals are the same, and the respective gate driving circuits are used to output scan signals to corresponding gate lines sequentially under the control of a received corresponding group of timing control signals.

3. The display panel according to claim 2, wherein when receiving the first mode control signal, the mode switching circuit controls the drive controlling circuit to output a second group of timing control signals to the second gate driving circuit while outputting a first group of timing control signals to the first gate driving circuit, and to output a fourth group of timing control signals to the fourth gate driving circuit while outputting a third group of timing control signals to the third gate driving circuit; wherein timings of respective signals in the first group of timing control signals are the same as timings of corresponding signals in the second group of timing control signals, timings of respective signals in the third group of timing control signal are the same as timings of corresponding signals in the fourth group of timing control signals, and timings of respective signals in the third group of timing control signals delay one trigger signal width compared with timings of corresponding signals in the first group of timing control signals.

4. The display panel according to claim 2, wherein when receiving a second mode control signal, the mode switching circuit controls the drive controlling circuit to output the second group of timing control signals to the second gate driving circuit while outputting the first group of timing control signals to the first gate driving circuit, to output the third group of timing control signals to the third gate driving circuit, and to output the fourth group of timing control signals to the fourth gate driving circuit; wherein timings of respective signals in the first group of timing control signals are the same as timings of corresponding signals in the second group of timing control signals, timings of corresponding signals in the third group of timing control signal, and timings of corresponding signal in the fourth group of timing control signals.

5. The display panel according to claim 2, wherein the mode switching circuit is further configured to:

control the drive controlling circuit to drive all the gate driving circuits to output scan signals to the N gate lines sequentially in scanning direction when receiving the third mode control signal.

6. The display panel according to claim 5, wherein when receiving the third mode control signal, the mode switching circuit controls the drive controlling circuit to output sequentially the first group of timing control signals to the first gate driving circuit, outputs the second group of timing control signals to the second gate driving circuit, outputs the third group of timing control signal to the third gate driving circuit, and output the fourth group of timing control signals to the fourth gate driving circuit sequentially; wherein timings of respective signals in the second group of timing control signals delay one half trigger signal width compared with timings of corresponding signals in the first group of timing control signals; timings of respective signals in the third group of timing control signals delay one half trigger signal width compared with timings of corresponding signals in the second group of timing control signals; and timings of respective signals in the fourth group of timing control signals delay one half trigger signal width compared with timings of corresponding signals in the third timing control signal.

7. The display panel according to claim 1, wherein the display panel is a liquid crystal display panel or an organic light-emitting display panel.

8. A driving method of the display panel according to claim 1, comprising:

controlling the drive controlling circuit to drive all gate driving circuits to output scan signals sequentially to respective first gate line groups by taking two adjacent gate lines as the first gate line group in scanning direction when the mode switching circuit receives a first mode control signal;

controlling the drive controlling circuit to drive all the gate driving circuits to output scan signals sequentially to respective second gate line groups by taking adjacent four gate lines as the second gate line group in scanning direction when the mode switching circuit receives a second mode control signal; and controlling the drive controlling circuit to drive all gate driving circuits to output scan signals sequentially to the N gate lines in scanning direction when the mode switching circuit receives a third mode control signal.

9. The driving method according to claim 8, wherein when the mode switching circuit receives a first mode control signal, the mode switching circuit controls the drive controlling circuit to output a second group of timing control signals to the second gate driving circuit while outputting a first group of timing control signals to the first gate driving circuit, and to output a fourth group of timing control signals to the fourth gate driving circuit while outputting a third group of timing control signals to the third gate driving circuit; wherein timings of respective signals in the first group of timing control signals are the same as timings of corresponding signals in the second group of timing control signals, timings of respective signals in the third group of timing control signal are the same as timings of corresponding signals in the fourth group of timing control signals, and timings of respective signals in the third group of timing control signals delay one trigger signal width compared with the timings of corresponding signals in the first group of timing control signals.

10. The driving method according to claim 8, wherein when receiving a second mode control signal, the mode switching circuit controls the drive controlling circuit to output the second group of timing control signals to the second gate driving circuit while outputting the first group of timing control signals to the first gate driving circuit, to output the third group of timing control signals to the third gate driving circuit, and to output the fourth group of timing control signals to the fourth gate driving circuit; wherein timings of respective signals in the first group of timing control signals are the same as timings of corresponding signals in the second group of timing control signals, timings of corresponding signals in the third group of timing control signal, and timings of corresponding signal in the fourth group of timing control signals.

11. The driving method according to claim 8, wherein

When receiving a third mode control signal, the mode switching circuit controls the drive controlling circuit to output the second group of timing control signals to the second gate driving circuit while outputting the first group of timing control signals to the first gate driving circuit, and to output the fourth group of timing control signals to the fourth gate driving circuit while outputting the third group of timing control signals to the third gate driving circuit; wherein timings of respective signals in the second group of timing control signals delay one half trigger signal width compared with timings of corresponding signals in the first group of timing control signals; timings of respective signals in the third group of timing control signals delay one half trigger signal width compared with timings of corresponding signals in the second group of timing control signals; and timings of respective signals in the fourth group of timing control signals delay one half trigger signal width compared with timings of corresponding signals in the third timing control signal.

12. A display apparatus, comprising the display panel according to claim 1.

13. The display apparatus according to claim 12, wherein respective groups of timing control signals comprise at least a trigger signal and a clock signal, and widths of trigger signals in the respective groups of timing control signals are the same, and the respective gate driving circuits are used to output scan signals to corresponding gate lines sequentially under the control of a received corresponding group of timing control signals.

14. The display apparatus according to claim 13, wherein when receiving the first mode control signal, the mode switching circuit controls the drive controlling circuit to output a second group of timing control signals to the second gate driving circuit while outputting a first group of timing control signals to the first gate driving circuit, and to output a fourth group of timing control signals to the fourth gate driving circuit while outputting a third group of timing control signals to the third gate driving circuit; wherein timings of respective signals in the first group of timing control signals are the same as timings of corresponding signals in the second group of timing control signals, timings of respective signals in the third group of timing control signal are the same as timings of corresponding signals in the fourth group of timing control signals, and timings of respective signals in the third group of timing control signals delay one trigger signal width compared with timings of corresponding signals in the first group of timing control signals.

15. The display apparatus according to claim 13, wherein when receiving a second mode control signal, the mode switching circuit controls the drive controlling circuit to output the second group of timing control signals to the second gate driving circuit while outputting the first group of timing control signals to the first gate driving circuit, to output the third group of timing control signals to the third gate driving circuit, and to output the fourth group of timing control signals to the fourth gate driving circuit; wherein timings of respective signals in the first group of timing control signals are the same as timings of corresponding signals in the second group of timing control signals, timings of corresponding signals in the third group of timing control signal, and timings of corresponding signal in the fourth group of timing control signals.

16. The display apparatus according to claim 13, wherein the mode switching circuit is further configured to:

control the drive controlling circuit to drive all the gate driving circuits to output scan signals to the N gate lines sequentially in scanning direction when receiving the third mode control signal.

17. The display apparatus according to claim 16, wherein when receiving the third mode control signal, the mode switching circuit controls the drive controlling circuit to output sequentially the first group of timing control signals to the first gate driving circuit, outputs the second group of timing control signals to the second gate driving circuit, outputs the third group of timing control signal to the third gate driving circuit, and output the fourth group of timing control signals to the fourth gate driving circuit sequentially; wherein timings of respective signals in the second group of timing control signals delay one half trigger signal width compared with timings of corresponding signals in the first group of timing control signals; timings of respective signals in the third group of timing control signals delay one half trigger signal width compared with timings of corresponding signals in the second group of timing control signals; and timings of respective signals in the fourth group of timing control signals delay one half trigger signal width compared with timings of corresponding signals in the third timing control signal.

18. The display apparatus according to claim 12, wherein the display panel is a liquid crystal display panel or an organic light-emitting display panel.

* * * * *